US009232580B2

(12) United States Patent
Lee et al.

(10) Patent No.: US 9,232,580 B2
(45) Date of Patent: Jan. 5, 2016

(54) VOLTAGE CONTROL CIRCUIT FOR DIMMER AND DIMMING METHOD USING THE SAME

(71) Applicant: SAMSUNG ELECTRO-MECHANICS CO., LTD., Gyeonggi-do (KR)

(72) Inventors: Yun Joong Lee, Seoul (KR); Je Hyeon Yu, Osan-si (KR); Chang Seok Lee, Suwon-si (KR); Chan Woo Park, Suwon-si (KR)

(73) Assignee: SAMSUNG ELECTRO-MECHANICS CO., LTD., Gyeonggi-Do (KR)

( * ) Notice: Subject to any disclaimer, the term of this patent is extended or adjusted under 35 U.S.C. 154(b) by 192 days.

(21) Appl. No.: 14/146,229

(22) Filed: Jan. 2, 2014

(65) Prior Publication Data

US 2015/0002041 A1 Jan. 1, 2015

(30) Foreign Application Priority Data

Jun. 28, 2013 (KR) ..... 10-2013-0075675

(51) Int. Cl.
*H05B 37/02* (2006.01)
*H05B 33/08* (2006.01)

(52) U.S. Cl.
CPC ..... *H05B 33/0815* (2013.01)

(58) Field of Classification Search
CPC ..... H05B 33/0851; H05B 33/0824; H05B 33/0845; H05B 33/0815; H05B 33/0839; H05B 37/02; H03K 17/063; H03K 17/687; H03K 17/162; H02M 3/33507; H02M 3/33523; H02M 3/157; H02M 1/42; G05F 3/08
USPC ..... 315/206, 201, 250, 210, 219, 279, 224, 315/200 R, 193, 291, 307, 312; 363/21.16, 363/21.01, 21.18; 327/299; 323/283
See application file for complete search history.

(56) References Cited

U.S. PATENT DOCUMENTS 8,098,027 B2 * 1/2012 Tsai ..... H05B 33/0815 315/209 R
8,587,209 B2 * 11/2013 Soleno ..... H05B 33/0815 315/206

(Continued)

FOREIGN PATENT DOCUMENTS

JP 2008527667 A 7/2008

*Primary Examiner* — Lincoln Donovan
*Assistant Examiner* — Thomas Skibinski
(74) *Attorney, Agent, or Firm* — Bracewell & Giuliani LLP; Brad Y. Chin

(57) ABSTRACT

Disclosed herein is a voltage control circuit for a dimmer and a dimming method. In accordance with an embodiment, the dimming method using a voltage control circuit for a dimmer includes the steps of determining whether a current voltage value input to a constant dimming range maintainer is equal to a preset minimum or maximum voltage value or exists between the minimum and maximum voltage values, and determining whether the current voltage value is greater than the maximum voltage value when the current voltage value isn't equal to the minimum or maximum voltage value or doesn't exist between the minimum and maximum voltage values. The method further includes the steps of updating the minimum voltage value to the current voltage value when the current voltage value isn't greater than the maximum voltage value, and updating the maximum voltage value to the current voltage value when the current voltage value is greater than the maximum voltage value.

10 Claims, 3 Drawing Sheets

(56) References Cited

U.S. PATENT DOCUMENTS

2010/0148681 A1* 6/2010 Kuo ..... H05B 33/0818 315/193
2011/0227499 A1 9/2011 Huang
2014/0176001 A1* 6/2014 Seo ..... H05B 33/0845 315/224

* cited by examiner

- PRIOR ART-

VOLTAGE CONTROL CIRCUIT FOR DIMMER AND DIMMING METHOD USING THE SAME

RELATED APPLICATION

This application claims the benefit of and priority under 35 U.S.C. §119 to Korean Patent Application No. KR 10-2013-0075675, filed on Jun. 28, 2013, Which is hereby incorporated by reference in its entirety into this application.

BACKGROUND

1. Field of the Invention

The present invention relates to a voltage control circuit for a dimmer, and more particularly, to a voltage control circuit for a dimmer that supplies a constant voltage to a lighting device regardless of a dimmer by adding a means for converting the voltage changed due to the dimmer into the constant voltage, and a dimming method using the same.

2. Description of the Related Art

A lighting device using a light emitting diode (LED) has advantages, such as long life and low power consumption, compared to existing lighting devices. However, the LED lighting device has a problem with compatibility with an existing dimmer installed according to characteristics of an incandescent. The dimmer is an apparatus that adjusts brightness of a lamp (for example, an incandescent or a halogen lamp) by varying AC input power. Since the driving range of the dimmer is diverse, it is needed to develop an LED lighting device that shows the same characteristics in all dimmers.

A problem in a conventional primary-side regulation (PSR) topology for lighting devices, as shown in FIG. 1, is that the range of a reference voltage Vref is changed according to the type of the dimmer. In the PSR topology, the brightness of an LED, that is, the light quantity is proportional to the size of the reference voltage Vref. From user's viewpoint, it means that the light quantity of the LED is changed whenever using different dimmers.

SUMMARY

Embodiments of the present invention overcome the above-described problems and it is, therefore, an object of various embodiments of the present invention to provide a voltage control circuit for a dimmer that supplies a constant voltage to a lighting device regardless of dimmer by adding a means for converting the voltage changed due to the dimmer into a constant voltage, and a dimming method using the same.

In accordance with an embodiment of the present invention, there is provided a voltage control circuit for a dimmer including a voltage generation unit for receiving AC power through a dimmer to generate a DC voltage suitable for a corresponding lighting device; a dimming detection unit for detecting a current dimming value, which is dimmed by applying the voltage generated by the voltage generation unit to the lighting device, as a voltage; a constant dimming range maintainer (CDRM) for converting the voltage applied to the lighting device into a constant range by extracting a minimum voltage value and a maximum voltage value of a current voltage based on the voltage detected by the dimming detection unit and detecting minimum and maximum voltage value ranges of the dimmer based on the extracted voltage values; a transformer for converting the voltage generated by the voltage generation unit into a voltage of different size for lighting of the lighting device; and a switching device for controlling the flow of a current to a primary side coil of the transformer.

In accordance with an embodiment, the CDRM includes a dimming area sensor for converting the voltage (analog value) detected by the dimming detection unit into a digital value; a dimming area memory for estimating and storing the minimum voltage value and the maximum voltage value of the dimmer; and a constant dimming converter for converting a current dimming area detected by the dimming detection unit into a constant dimming area by referring to the minimum voltage value and the maximum voltage value stored in the dimming area memory.

In accordance with an embodiment, the voltage control circuit for a dimmer further includes a comparator for receiving and comparing a voltage according to the current flowing through the switching device and an output voltage from the CDRM and amplifying an error to output the amplified error.

In accordance with an embodiment, the voltage control circuit for a dimmer further includes a latch unit fix turning off the switching device by outputting a reset signal when the voltage according to the current flowing through the switching device is higher than the output voltage from the CDRM as the result of the comparison by the comparator.

In accordance with an embodiment, the voltage control circuit for a dimmer further includes an oscillator for providing the latch unit with a clock signal for setting the switching device to turn on the switching device.

In accordance with an embodiment, the dimming detection unit includes first and second resistors connected in series and a first capacitor connected in parallel to the first resistor.

In accordance with another embodiment of the present invention, there is provided a dimming method using a voltage control circuit for a dimmer, including the steps of a) determining by a CDRM whether a current voltage value input to the CDRM is equal to a preset minimum voltage value or maximum voltage value or exists between the minimum voltage value and the maximum voltage value; b) determining whether the current voltage value is greater than the maximum voltage value when the current voltage value is not equal to the minimum voltage value or the maximum voltage value or does not exist between the minimum voltage value and the maximum voltage value; c) updating the minimum voltage value to the current voltage value when the current voltage value is not greater than the maximum voltage value and d) updating the maximum voltage value to the current voltage value when the current voltage value is greater than the maximum voltage value.

In accordance with an embodiment of the invention, the dimming method further includes the step of continuously determining whether the current voltage value input to the CDRM is equal to the minimum voltage value or the maximum voltage value or exists between the minimum voltage value and the maximum voltage value when the current voltage value is equal to the minimum voltage value or the maximum voltage value or exists between the minimum voltage value and the maximum voltage value in the determination of the step a).

In accordance with an embodiment of the invention, the CDRM has an algorithm (software program) for performing the steps a) to d).

In accordance with an embodiment, the CDRM has an algorithm represented by the following Equation that maintains the light quantity of the lighting device constantly regardless of the type of the mounted dimmer:

$$REF = (REF.\mathrm{MAX} - REF.\mathrm{MIN})\frac{\mathrm{Current} - \mathrm{MIN}.DIM}{\mathrm{MAX}.DIM - \mathrm{MIN}.DIM} + REF.\mathrm{MIN}$$

where REF represents a reference voltage value, REF.MAX represents a maximum reference voltage value, REF.MIN represents a minimum reference voltage value, Current represents a current voltage value input to the CDRM, MIN.DIM represents a current minimum voltage value, and MAX.DIM represents a current maximum voltage value.

Various objects, advantages and features of the invention will become apparent from the following description of embodiments with reference to the accompanying drawings.

BRIEF DESCRIPTION OF DRAWINGS

These and other features, aspects, and advantages of the invention are better understood with regard to the following Detailed Description, appended Claims, and accompanying Figures. It is to be noted, however, that the Figures illustrate only various embodiments of the invention and are therefore not to be considered limiting of the invention's scope as it may include other effective embodiments as well.

DETAILED DESCRIPTION

The present invention will now be described more fully hereinafter with reference to the accompanying drawings, which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout. Prime notation, if used, indicates similar elements in alternative embodiments.

Figure 1:
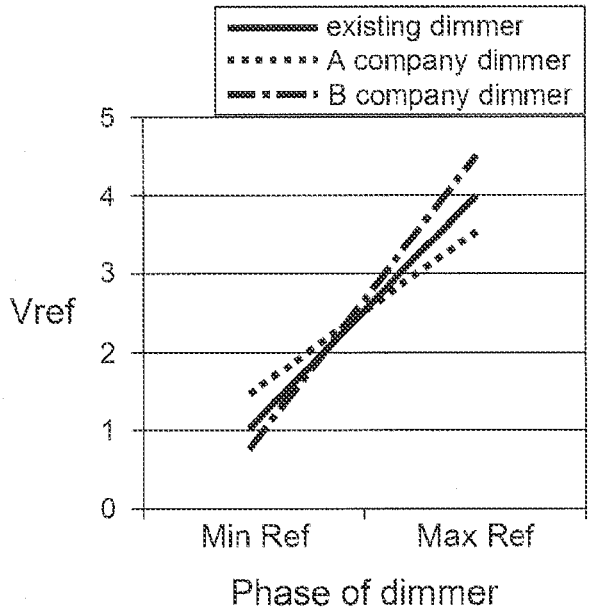
FIG. 1 is a view showing changes in the range of a reference voltage Vref according to the type of a dimmer in a conventional PSR topology.
Figure 2:
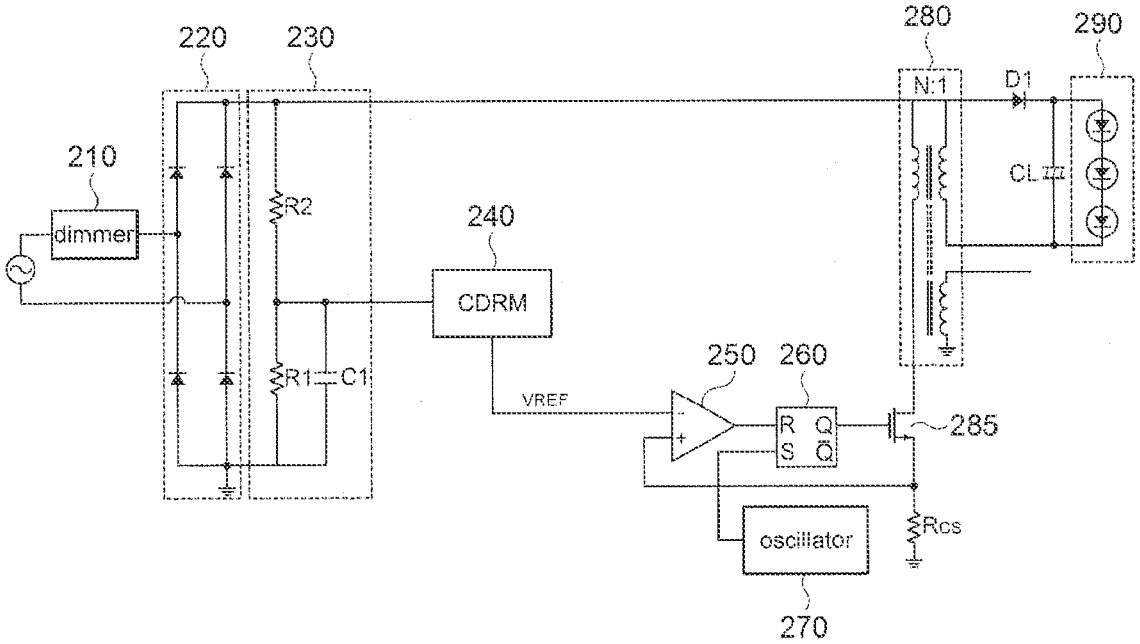
FIG. 2 is a view schematically showing a configuration of a voltage control circuit for a dimmer, in accordance with an embodiment of the invention.
Figure 3:
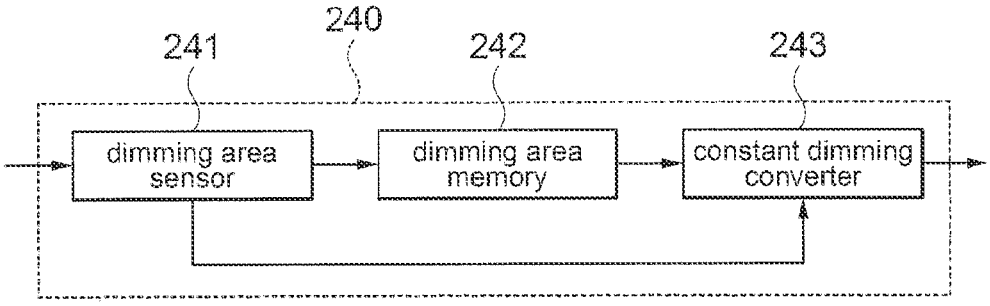
FIG. 3 is a view showing an internal system configuration of a CDRM in the voltage control circuit for a dimmer of FIG. 2, in accordance with an embodiment of the invention.

FIG. 2 is a view schematically showing a configuration of a voltage control circuit for a dimmer, in accordance with an embodiment of the invention.

Referring to FIG. 2, a voltage control circuit for a dimmer in accordance with an embodiment of the present invention includes a voltage generation unit 220, a dimming detection unit 230, a constant dimming range maintainer (CDRM) 240, a transformer 280, and a switching device 285.

The voltage generation unit 220 receives AC power (for example, AC 220V) from the outside through a dimmer 210 to output a DC voltage suitable for a corresponding lighting device 290 (for example, an LED lamp). This voltage generation unit 220 may consist of a full wave rectification bridge diode.

The dimming detection unit 230 detects a current dimming value, which is dimmed by applying the voltage generated by the voltage generation unit 220 to the lighting device 290, as a voltage. This dimming detection unit 230, as shown, may consist of first and second resistors R1 and R2 connected in series and a first capacitor C1 connected in parallel to the first resistor R1.

In accordance with an embodiment, the first and second resistors R1 and R2 function as a voltage divider for dividing the voltage generated by the voltage generation unit 220, and the first capacitor C1 removes an AC component (or high frequency noise component) mixed in the voltage, which is generated by the voltage generation unit 220 to be supplied to the lighting device 290.

The CDRM 240 converts the voltage applied to the lighting device 290 into a predetermined range by extracting a minimum voltage value and a maximum voltage value of the current voltage based on the voltage detected by the dimming detection unit 230 and detecting minimum and maximum voltage value ranges of the dimmer 210 based on the extracted voltage values.

As shown in FIG, 3, the CDRM 240 includes a dimming area sensor 241, a dimming area memory 242, and a constant dimming converter 243. The dimming area sensor 241 converts the voltage (analog value) detected by the dimming detection unit 230 into a digital value. This dimming area sensor 241 may be an analog-to-digital converter.

In accordance with an embodiment, the dimming area memory 242 estimates and stores the minimum voltage value and the maximum voltage value of the dimmer 210. This dimming area memory 242 may be an electrically erasable and programmable ROM (EEPROM), etc.

The constant dimming converter 243 converts a current dimming area detected by the dimming detection unit 230 into a constant dimming area by referring to the minimum voltage value and the maximum voltage value stored in the dimming area memory 242. This constant dimming converter 243 converts a digital value into an analog value to output the analog value. Therefore, the constant dimming converter 243 may be a digital-to-analog converter. Further, the output from the constant dimming converter 243 is used as a reference voltage Vref as a one side input clement of a comparator 250, which will be described later.

In accordance with an embodiment, the transformer 280 converts the voltage generated by the voltage generation unit 220 into a voltage (that is, a DC voltage of different size, for example, DC 24V or DC 12V) of different size for lighting of the lighting device 290. This transformer 280 obtains various voltage values at a secondary side thereof according to the turn ratio between primary and secondary windings. Further, the transformer 280 can obtain more various voltage values by further including an auxiliary winding as in this example.

The switching device 285 controls the flow of a current to a primary side coil of the transformer 280. This switching device 285 may be a semiconductor switch device, for example, a MOSFET.

The voltage control circuit for a dimmer, in accordance with an embodiment of the present invention, is configured as above preferably further includes the comparator 250, which compares a voltage (that is, a voltage applied to both ends of a resistor Rcs by a current flowing in the resistor Rcs) according to the current flowing through the switching device 285 and the output voltage Vref from the CDRM 240 and amplifies an error to output the amplified error.

Further, the voltage control circuit for a dimmer, in accordance with an embodiment of the present invention, further includes a latch unit 260, which turns off the switching device 285 by outputting a reset signal when the voltage according to the current flowing through the switching device 285 is higher than the output voltage Vref from the CDRM 240.

Further, the voltage control circuit for a dimmer, in accordance with an embodiment of the present invention, further includes an oscillator 270, which provides the latch unit 260 with a clock signal for setting the switching device 285 to turn on the switching device 285.

A dimming method using the voltage control circuit for a dimmer, in accordance with an embodiment of the present invention configured as above, will be described briefly below.

Figure 4:
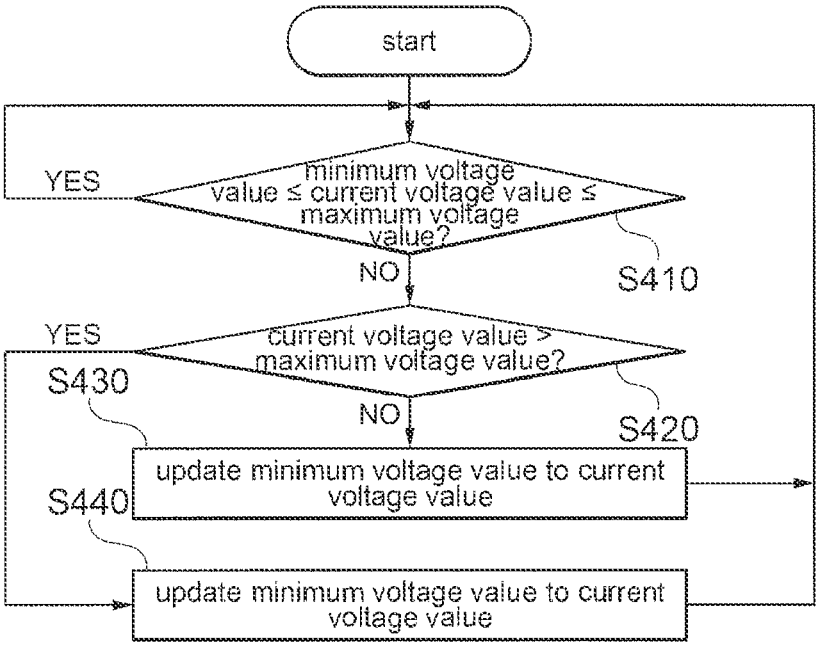
FIG. 4 is a flowchart showing a process of executing a dimming method using a voltage control circuit for a dimmer, in accordance with an embodiment of the invention.

FIG. 4 is a flowchart showing a process of executing a dimming method using a voltage control circuit for a dimmer, in accordance with an embodiment of the invention.

Referring to FIG. 4, according to the dimming method using a voltage control circuit for a dimmer, in accordance with an embodiment of the present invention, first, it is determined by a CDRM 240 whether a current voltage value input to the CDRM 240 is equal to a minimum voltage value or a maximum voltage value preset by a user or exists between the minimum voltage value and the maximum voltage value (S410).

It is determined by the CDRM 240 whether the current voltage value is greater than the maximum voltage value when the current voltage value is not equal to the minimum voltage value or the maximum voltage value or does not exist between the minimum voltage value and the maximum voltage value (it means that the current voltage value is smaller than the minimum voltage value or greater than the maximum voltage value) in the determination of the step S410 (S420).

The minimum voltage value is updated to the current voltage value by the CDRM 240 when the current voltage value is not greater than the maximum voltage value (it means that the current voltage value is smaller than the minimum voltage value) in the determination of the step S420 (S430).

The maximum voltage value is updated to the current voltage value by the CDRM 240 when the current voltage value is greater than the maximum voltage value in the determination of the step S420 (S440).

The dimming method using a voltage control circuit for a dimmer, in accordance with an embodiment of the present invention, further includes the step of continuously determining whether the current voltage value input to the CDRM 240 is equal to the minimum voltage value or the maximum voltage value or exists between the minimum voltage value and the maximum voltage value when the current voltage value is equal to the minimum voltage value or the maximum voltage value or exists between the minimum voltage value and the maximum voltage value in the determination of the step S410.

Further, in accordance with an embodiment of the invention, the CDRM 240 has an algorithm (software program) for performing the steps S410 to S440.

Meanwhile, in a series of processes as above, the voltage before the CDRM 240 may have various values according to the dimmer 210. Therefore, the CDRM 240 adjusts the minimum value and the maximum value of the reference voltage Vref in FIG. 2 to be maintained constantly by extracting the minimum value and the maximum value of the current voltage. At this time, the CDRM 240 can control the light quantity of the lighting device 290 to be maintained constantly using the following equation even though any dimmer 210 is mounted to the lighting device 290.

$$REF = (REF.\mathrm{MAX} - REF.\mathrm{MIN}) \frac{\mathrm{Current} - \mathrm{MIN}.DIM}{\mathrm{MAX}.DIM - \mathrm{MIN}.DIM} + REF.\mathrm{MIN} \quad \text{[Equation 1]}$$

Here, REF represents a reference voltage value, REF.MAX represents a maximum reference voltage value, REF.MIN represents a minimum reference voltage value, Current represents a current voltage value input to the CDRM 240, MIN.DIM represents a current minimum voltage value, and MAX.DIM represents a current maximum voltage value.

In accordance with an embodiment of the invention, Equation 1 is made by one algorithm (software program) to be stored in the dimming area memory 242 of the CDRM 240.

Figure 5:
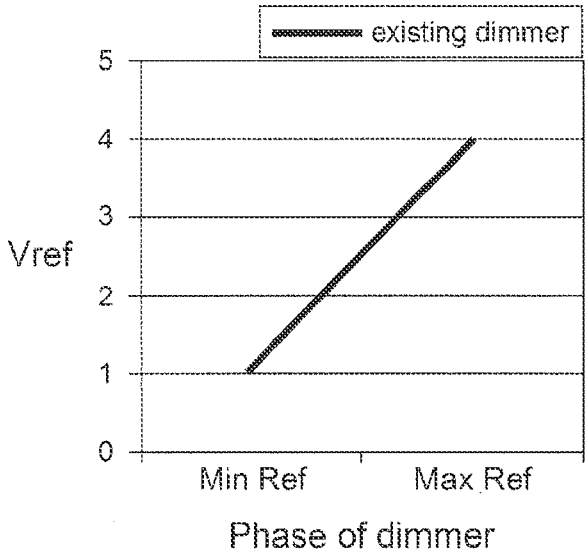
FIG. 5 is a view showing characteristics of the range of a voltage reference Vref in a lighting device to which the voltage control circuit for a dimmer, in accordance with an embodiment of the invention, is applied.

FIG. 5 is a view showing characteristics of the range of a voltage reference Vref in a lighting device to which the voltage control circuit for a dimmer, in accordance with an embodiment of the invention, is applied.

As shown in FIG. 5, in the lighting device to which the voltage control circuit for a dimmer, in accordance with an embodiment of the present invention, is applied, the range of the reference voltage Vref is constant regardless of the type of the mounted dimmer.

As described above, the voltage control circuit for a dimmer and the dimming method using the same, in accordance with an embodiment of the present invention, supplies a constant voltage to the lighting device regardless of the dimmer by detecting the minimum and maximum voltage value ranges of the dimmer using the CDRM to convert the detected range into a constant range regardless of the type of the dimmer.

According to the present invention as above, it is possible to supply a constant voltage to a lighting device regardless of a dimmer by adding a means for detecting minimum and maximum voltage value ranges of the dimmer to convert the detected range into a constant range.

Further, according to the present invention, since the circuit layer mounted therein with an optical element is made of a metallic conductor, light efficiency and radiation performance can be improved.

Embodiments of the present invention may suitably comprise, consist or consist essentially of the elements disclosed and may be practiced in the absence of an element not disclosed. For example, it can be recognized by those skilled in the art that certain steps can be combined into a single step.

The terms and words used in the present specification and claims should not be interpreted as being limited to typical meanings or dictionary definitions, but should be interpreted as having meanings and concepts relevant to the technical scope of the present invention based on the rule according to which an inventor can appropriately define the concept of the term to describe the best method he or she knows for carrying out the invention.

As used herein, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that the mere use of the term "first" and "second" does not require that there be any "third" component, although that possibility is contemplated under the scope of the embodiments of the present invention.

The singular forms "a," "an," and "the" include plural referents, unless the context clearly dictates otherwise.

As used herein and in the appended claims, the words "comprise," "has," and "include" and all grammatical variations thereof are each intended to have an open, non-limiting meaning that does not exclude additional elements or steps.

Ranges may be expressed herein as from about one particular value, and/or to about another particular value. When such a range is expressed, it is to be understood that another embodiment is from the one particular value and/or to the other particular value, along with all combinations within said range.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

What is claimed is:

1. A voltage control circuit for a dimmer, comprising:

a voltage generation unit configured to receive AC power through a dimmer to generate a DC voltage suitable for a corresponding lighting device;

a dimming detection unit configured to detect a current dimming value, which is dimmed by applying the voltage generated by the voltage generation unit to the lighting device, as a voltage;

a constant dimming range maintainer (CDRM) configured to convert the voltage applied to the lighting device into a constant range by extracting a minimum voltage value and a maximum Voltage value of a current voltage based on the voltage detected by the dimming detection unit and configured to detect minimum and maximum voltage value ranges of the dimmer based on the extracted voltage values;

a transformer configured to convert the voltage generated by the voltage generation unit into a voltage of different size for lighting of the lighting device; and a switching device configured to control the flow of a current to a primary side coil of the transformer.

2. The voltage control circuit for a dimmer according to claim 1, wherein the CDRM comprises:

a dimming area sensor configured to convert the voltage (analog value) detected by the dimming detection unit into a digital value;

a dimming area memory configured to estimate and store the minimum voltage value and the maximum voltage value of the dimmer; and a constant dimming converter configured to convert a current dimming area detected by the dimming detection unit into a constant dimming area by referring to the minimum voltage value and the maximum voltage value stored in the dimming area memory.

3. The voltage control circuit for a dimmer according to claim 1, further comprising:

a comparator configured to receive and compare a voltage according to the current flowing through the switching device and an output voltage from the CDRM and configured to amplify an error to output the amplified error.

4. The voltage control circuit for a dimmer according to claim 3, further comprising:

a latch unit configured to turn off the switching device by outputting a reset signal when the voltage according to the current flowing through the switching device is higher than the output voltage from the CDRM as the result of the comparison by the comparator.

5. The voltage control circuit for a dimmer according to claim 4, further comprising:

an oscillator configured to provide the latch unit with a clock signal for setting the switching device to turn on the switching device.

6. The voltage control circuit for a dimmer according to claim 1, wherein the dimming detection unit consists of first and second resistors connected in series and a first capacitor connected in parallel to the first resistor.

7. A dimming method using a voltage control circuit for a dimmer, comprising:

a) determining by a CDRM whether a current voltage value input to the CDRM is equal to a preset minimum voltage value or maximum voltage value or exists between the minimum voltage value and the maximum voltage value;

b) determining whether the current voltage value is greater than the maximum voltage value when the current voltage value is not equal to the minimum voltage value or the maximum voltage value or does not exist between the minimum voltage value and the maximum voltage value;

c) updating the minimum voltage value to the current voltage value When the current voltage value is not greater than the maximum voltage value; and d) updating the maximum voltage value to the current voltage value when the current voltage value is greater than the maximum voltage value.

8. The dimming method using a voltage control circuit for a dimmer according to claim 7, further comprising:

continuously determining whether the current voltage value input to the CDRM is equal to the minimum voltage value or the maximum voltage value or exists between the minimum voltage value and the maximum voltage value when the current voltage value is equal to the minimum voltage value or the maximum voltage value or exists between the minimum voltage value and the maximum voltage value in the determination of the step a).

9. The dimming method using a voltage control circuit for a dimmer according to claim 8, wherein the CDRM has an algorithm (software program) for performing the steps a) to d).

10. The dimming method using a voltage control circuit for a dimmer according to claim 7, wherein the CDRM has an algorithm represented by the following Equation that maintains the light quantity of the lighting device constantly regardless of the type of the mounted dimmer:

$$REF = (REF.\mathrm{MAX} - REF.\mathrm{MIN})\frac{\mathrm{Current} - \mathrm{MIN}.DIM}{\mathrm{MAX}.DIM - \mathrm{MIN}.DIM} + REF.\mathrm{MIN}$$

where REF represents a reference voltage value, REF.MAX represents a maximum reference voltage value, REF.MIN represents a minimum reference voltage value, Current represents a current voltage value input to the CDRM, MIN.DIM represents a current minimum voltage value, and MAX.DIM represents a current maximum voltage value.

* * * * *